US010174449B2

(12) United States Patent
Koike et al.

(10) Patent No.: US 10,174,449 B2
(45) Date of Patent: Jan. 8, 2019

(54) SEWING MACHINE

(71) Applicant: JANOME SEWING MACHINE CO., LTD., Tokyo (JP)

(72) Inventors: Mikio Koike, Ome (JP); Jun Mafune, Kokubunji (JP)

(73) Assignee: JANOME SEWING MACHINE CO., LTD., Tokyo (JP)

( * ) Notice: Subject to any disclaimer, the term of this patent is extended or adjusted under 35 U.S.C. 154(b) by 365 days.

(21) Appl. No.: 15/009,293

(22) Filed: Jan. 28, 2016

(65) Prior Publication Data

US 2016/0273144 A1 Sep. 22, 2016

(30) Foreign Application Priority Data

Mar. 20, 2015 (JP) ..... 2015-058102

(51) Int. Cl.
*D05B 29/02* (2006.01)
*D05B 19/16* (2006.01)

(52) U.S. Cl.
CPC ..... *D05B 29/02* (2013.01); *D05B 19/16* (2013.01); *D05D 2209/16* (2013.01)

(58) Field of Classification Search
CPC ..... D05B 19/00; D05B 19/12; D05B 19/16; D05B 2209/16; D05B 29/00; D05B 29/02; D05B 73/12; D05B 29/12; D05D 2209/16
USPC ..... 112/470.01, 470.03, 470.06
See application file for complete search history.

(56) References Cited

U.S. PATENT DOCUMENTS 1,394,075 A * 10/1921 Finch ..... D05B 19/00 112/274
2,854,935 A * 10/1958 Bungert ..... D05B 19/00 112/464
3,141,432 A * 7/1964 Reeber ..... D05B 65/00 112/292

(Continued)

FOREIGN PATENT DOCUMENTS

CN 101457448 A 6/2009
CN 101922089 A 12/2010

(Continued)

OTHER PUBLICATIONS

Office action dated Nov. 23, 2016 for corresponding TW application 104135684 with English translation.

(Continued)

*Primary Examiner* — Ismael Izaguirre
(74) *Attorney, Agent, or Firm* — Nath, Goldberg & Meyer; Jerald L. Meyer

(57) ABSTRACT

A sewing machine moves a presser foot up and down through a presser-bar lifting lever to depress a cloth. The lever is moved down by a stepping motor at a constant move-down amount. A compression spring is present between the stepping motor and the presser foot. The compression spring is compressed by some of the constant move-down amount of the lever, and applies, to the presser foot, pushing force canceling repulsive force from the depressed cloth. The move-down amount of the presser foot is detected by an encoder, and a thickness of the cloth is calculated by a cloth-thickness calculator. The cloth-thickness calculator performs calculation based on the move-down amounts at two timings in a time period at which the presser foot depresses the cloth and attempts to further move down.

5 Claims, 7 Drawing Sheets

(56) References Cited

U.S. PATENT DOCUMENTS 3,638,593 A * 2/1972 Vollmar ..... D05B 19/00 112/316
3,965,830 A * 6/1976 Dorosz ..... D05B 21/00 112/285
4,109,596 A * 8/1978 Blessing ..... D05B 27/12 112/309
4,188,895 A * 2/1980 Johnson ..... D05B 19/00 112/462
4,215,641 A * 8/1980 Dobrjanskyj ..... D05B 19/12 112/241
4,295,435 A * 10/1981 Uemura ..... D05B 27/10 112/322
4,428,311 A * 1/1984 Sano ..... D05B 93/00 112/466
4,577,575 A * 3/1986 Stevens ..... D05B 19/00 112/448
4,587,911 A * 5/1986 Kinoshita ..... D05B 29/00 112/239
4,612,867 A * 9/1986 Rosch ..... D05B 35/102 112/314
4,633,794 A * 1/1987 Kato ..... D05B 29/00 112/254
4,658,741 A * 4/1987 Jehle ..... D05B 35/102 112/131
4,704,978 A * 11/1987 Nomura ..... D05B 19/00 111/239
4,716,846 A * 1/1988 Schneider ..... D05B 29/00 112/236
4,776,293 A * 10/1988 Yoshida ..... D05B 51/00 112/254
4,791,876 A * 12/1988 Sasaki ..... D05B 51/00 112/241
4,869,187 A * 9/1989 Little ..... D05B 29/02 112/235
4,949,657 A * 8/1990 Hanyu ..... D05B 47/04 112/241
4,960,062 A * 10/1990 Hanyu ..... D05B 47/04 112/255
4,967,679 A * 11/1990 Hara ..... D05B 45/00 112/255
5,022,335 A * 6/1991 Hanyu ..... D05B 45/00 112/255
5,042,406 A * 8/1991 Jimenez ..... D05B 29/02 112/237
5,095,834 A * 3/1992 Braun ..... D05B 19/00 112/221
5,186,115 A * 2/1993 Rouleau ..... D05B 35/102 112/153
5,596,941 A * 1/1997 Landen ..... D05B 29/02 112/235
5,694,872 A * 12/1997 Zeller ..... D05B 11/00 112/117
6,000,350 A * 12/1999 Koike ..... D05B 19/10 112/102.5
6,024,036 A * 2/2000 Miyachi ..... D05B 27/14 112/141
6,095,071 A * 8/2000 Kozima ..... D05B 69/36 112/470.01
6,591,769 B1 * 7/2003 Heidtmann ..... D05B 29/02 112/237
7,571,689 B2 * 8/2009 Joe ..... D05B 29/02 112/236
7,654,209 B2 * 2/2010 Park ..... D05B 19/12 112/220
8,573,145 B2 * 11/2013 Dickerson ..... D05B 19/16 112/314
9,624,611 B2 * 4/2017 Nakajima ..... D05B 47/04
9,845,559 B2 * 12/2017 Koike ..... D05B 29/02
2006/0011121 A1 * 1/2006 Fujihara ..... D05B 19/12 112/470.01
2006/0090681 A1 * 5/2006 Ota ..... D05B 19/16 112/459
2007/0044697 A1 * 3/2007 Shomura ..... D05B 29/00 112/236
2008/0078313 A1 * 4/2008 Hamajima ..... D05B 11/00 112/117
2008/0229990 A1 * 9/2008 Ishikawa ..... D05B 3/02 112/462
2008/0229992 A1 * 9/2008 Nakamura ..... D05B 19/12 112/470.03
2009/0107374 A1 * 4/2009 Ukai ..... D05B 3/04 112/470.06
2009/0188414 A1 * 7/2009 Tokura ..... D05B 19/10 112/457
2009/0217850 A1 * 9/2009 Tokura ..... D05B 19/16 112/102.5
2009/0301369 A1 * 12/2009 Kawaguchi ..... D05B 19/12 112/274
2010/0313805 A1 * 12/2010 Kishi ..... D05B 19/14 112/470.01
2011/0203505 A1 * 8/2011 Nagai ..... D05B 29/02 112/235
2011/0303138 A1 * 12/2011 Flygare ..... D05B 19/16 112/470.03
2012/0006241 A1 * 1/2012 Nishiyama ..... D05B 3/02 112/221
2012/0048163 A1 * 3/2012 Tokura ..... D05B 3/06 112/447
2012/0073484 A1 * 3/2012 Nakamura ..... D05B 19/12 112/154
2013/0233221 A1 * 9/2013 Abe ..... D05B 19/12 112/470.06
2013/0247805 A1 * 9/2013 Magara ..... D05B 19/12 112/470.06
2014/0026794 A1 * 1/2014 Imaizumi ..... D05B 19/12 112/470.01
2014/0083345 A1 * 3/2014 Tokura ..... D05B 19/08 112/470.01
2015/0090168 A1 * 4/2015 Kobayashi ..... D05B 53/00 112/470.03
2015/0094842 A1 * 4/2015 Kobayashi ..... D05B 19/14 700/137
2016/0237604 A1 * 8/2016 Nakajima ..... D05B 19/12
2016/0258093 A1 * 9/2016 Koike ..... D05B 19/16
2016/0273144 A1 * 9/2016 Koike ..... D05B 29/02
2017/0073864 A1 * 3/2017 Nakajima ..... D05B 19/003
2017/0121878 A1 * 5/2017 Koike ..... D05B 27/08
2017/0260671 A1 * 9/2017 Suzuki ..... D05C 9/18

FOREIGN PATENT DOCUMENTS

CN 102787455 A 11/2012
JP H05300988 A 11/1993
JP H0941258 A 2/1997
JP 2006020757 A 1/2006
TW M259800 U 3/2005
TW 200632171 A 9/2006
TW 201400664 A 1/2014

OTHER PUBLICATIONS

Office Action dated May 4, 2018, for corresponding CN application No. 201510754152.5 with English translation.

* cited by examiner

SEWING MACHINE

CROSS-REFERENCE TO RELATED APPLICATION

This application is based upon and claims the benefit of priority from Japan Patent Application No. 2015-058102, filed on Mar. 20, 2015, the entire contents of which are incorporated herein by reference.

FIELD OF THE INVENTION

The present invention relates to a stitchwork sewing machine.

BACKGROUND

Sewing by a sewing machine is performed while a cloth is held by a presser foot. The presser foot has a primary function of suppressing, when a needle is pulled out from a cloth, an uplifting of the cloth associated with the pulled-out needle. In addition, the presser foot has a secondary function of holding the cloth together with a feed dog, and smoothly feeding the cloth. In order to fully accomplish such functions, it is necessary to appropriately control depress force applied to the cloth from the presser foot.

A sewing machine intertwines a needle thread with a bobbin thread, thereby forming a seam. When the seam is too tight, a cloth with high stretch properties, such as a jersey cloth or a knit cloth, causes a material puckering, and when the seam is too loose, the threads are likely to come apart from each other. Hence, it is necessary to control the tension of thread (stitch balancing thread tension) based on the thickness of a cloth and the stretch properties thereof.

In order to forma stitchwork on the cloth, the cloth is held on not a feed dog but a stitchwork frame, and is translated in the vertical and horizontal directions by a frame driving mechanism. Hence, when a sewing machine is utilized for a stitchwork formation, a presser foot is lifted up from the surface of the cloth by a predetermined distance before the stitchwork formation starts, and then the stitchwork formation is started (see, for example, JP2006-20757 A). In order to cause the presser foot to properly function during the stitchwork formation, it is necessary to properly control the positional relationship between the presser foot and the cloth based on the thickness of the cloth.

In addition, when a stitchwork formation is performed on a cloth with high stretch properties like a quilt, the actual height of the presser foot is likely to be lower than the set distance relative to the cloth, causing an improper sewing. Hence, as for a cloth with high stretch properties, it is necessary to properly control the positional relationship between the presser foot and the cloth based on the thickness of the cloth and the stretch amount thereof.

As explained above, according to conventional technologies, like the disclosure of JP2006-20757 A, the thickness of a cloth is detected, and a sewing condition is set in accordance with the thickness of the cloth. As for the thickness of the cloth, the presser foot is moved down toward the cloth, and when the presser foot stops due to repulsive force from the cloth, the height of the presser foot at this time point is determined as the thickness of the cloth.

However, all cloths naturally have stretch properties. When the stop height of the presser foot is set as the thickness of a cloth, the thickness of the cloth depressed by the presser foot is to be detected, and thus it is difficult to detect the thickness of the cloth when no load is applied. In addition, the stretch properties of a cloth vary depending on a cloth type. That is, the depress amount of a cloth by the presser foot varies depending on the cloth type, and it is difficult to set the thickness of the cloth when no load is applied based on the thickness of the depressed cloth.

Hence, according to conventional cloth-thickness detecting schemes, it is difficult to set a sewing condition in accordance with the thickness of a cloth when no load is applied, which does not contribute to an improvement of sewing quality and stitchwork quality. In fact, when an actual difference between the thickness of the cloth when no load is applied and the thickness of the cloth based on the conventional cloth-thickness detection is large, a sewing condition set up based on the conventional schemes sometimes results in a deterioration of sewing quality and stitchwork quality.

The present invention has been proposed in order to address the above technical problems of conventional technologies, and it is an objective of the present invention to provide a sewing machine which is capable of detecting a thickness of a cloth and stretch properties thereof when no load is applied, and which is also capable of improving a sewing quality and a stitchwork quality through a setting of a sewing condition based on the detected thickness and stretch properties.

SUMMARY OF THE INVENTION

In order to accomplish the above objective, a sewing machine according to an aspect of the present invention includes:

- a presser foot attached to a lower end of a presser bar supported by a sewing machine frame so as to be movable up and down, the presser foot depressing a cloth to be sewn;
- a lever linking to the presser foot moves up and down relative to the cloth;
- an actuator moving down the lever at a constant move-down amount to depress the cloth with the presser foot;
- an elastic body present between the actuator and the presser foot, the elastic body being compressed by the move-down operation of the lever at the constant move-down amount, and applying, to the presser foot, pushing force that cancels repulsive force from the depressed cloth;
- an encoder detecting a move-down amount of the presser foot; and
- a calculator calculating a thickness of the cloth based on the move-down amount detected by the encoder at two timings during a time period at which the presser foot depresses the cloth and attempts to further move down.

The calculator may:

- calculate the pushing force that is equal to the repulsive force based on a compression amount of the elastic body on a basis of the constant move-down amount of the lever and the move-down amount of the presser foot;
- calculate a height of the presser foot at a timing at which the calculated pushing force becomes zero; and
- determine the calculated height of the presser foot as the thickness of the cloth.

The calculator may create, based on an initial height Do of the presser foot, a spring constant ks of the elastic body, move-down amounts dc(t1), dc(t2) at two timings t1, t2, and swing-down amounts do(t1), do(t2) of the presser-bar lifting lever at the two timings t1, t2, simultaneous equations including two equations from a following formula, solves the simultaneous equations, and obtains a thickness Lo;

$$(Do-dc(t))=A\times[ks\times(do(t)-dc(t))]+Lo,$$

where A and Lo are unknown quantities.

The calculator may:

calculate a compression amount of the cloth at a predetermined timing based on the thickness of the cloth and a height of the presser foot; and calculate stretch properties of the cloth based on the pushing force by the elastic body and the compression amount of the cloth.

The sewing machine may further include a controller changing a sewing condition based on at least either the thickness of the cloth or the stretch properties.

According to the present invention, it becomes possible for the sewing machine to detect a thickness of a cloth and stretch properties thereof when no load is applied. This enables an appropriate setting of a sewing condition, thereby improving a sewing quality and a stitchwork quality.

BRIEF DESCRIPTION OF THE DRAWINGS

FIG. 1A is an external appearance view, while FIG. 1B is an internal structural diagram;

DETAILED DESCRIPTION OF THE EMBODIMENTS (Entire Structure of Sewing Machine)

Figure 1A:
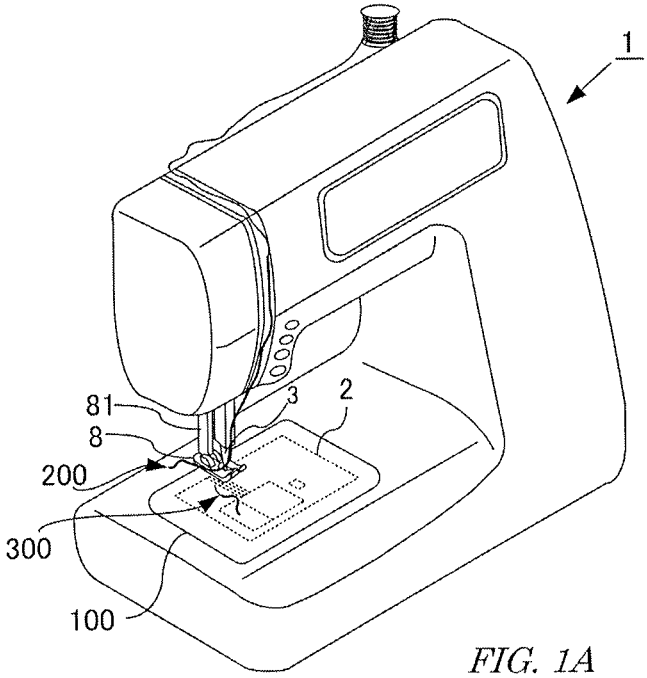
FIGS. 1A and 1B illustrate a structure of a sewing machine.
Figure 1B:
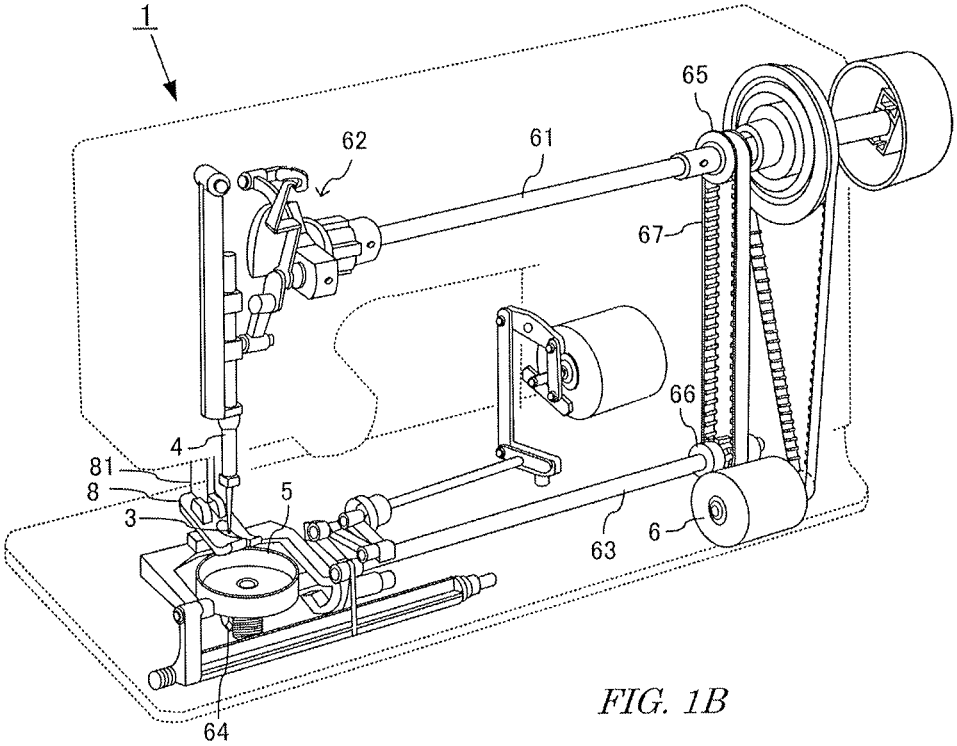

As illustrated in FIG. 1, a sewing machine 1 is a home, professional or industrial machine that locates a needle 3 while holding a cloth 100 mounted on a needle plate 2 by a presser foot 8, and intertwines a needle thread 200 with a bobbin thread 300, thereby forming a seam. This sewing machine 1 includes a needle bar 4 and a hook 5. The needle bar 4 extends vertically relative to the needle plate 2, and is attached so as to be movable up and down along the vertical direction. This needle bar 4 supports, at a tip toward the needle plate 2, the needle 3 that holds the needle thread 200. The hook 5 is formed in a hollow drum shape with an open plane, is attached horizontally or vertically relative to the needle plate 2, and is rotatable around the circumferential direction. In this embodiment, the hook 5 is attached horizontally. This hook 5 stores thereinside a bobbin around which a bobbin thread 300 is wound.

According to this sewing machine 1, by the up-and-down movement of the needle bar 4, the needle 3 together with the needle thread 200 passes completely through the cloth 100, and a needle thread loop due to a friction between the cloth 100 and the needle thread 200 is formed when the needle 3 moves up. Next, the rotating hook 5 catches the needle thread loop, and the bobbin that is supplying the bobbin thread 300 passes through the needle thread loop along with the rotation of the hook 5. Hence, the needle thread 200 and the bobbin thread 300 are intertwined with each other, and thus a seam is formed.

The needle bar 4 and the hook 5 are driven through various transmission mechanisms with a sewing-machine motor 6 being as a common drive source. The needle bar 4 is linked with, via a crank mechanism 62, an upper shaft 61 that extends horizontally. The rotation of the upper shaft 61 is converted into a linear motion by the crank mechanism 62, and is transmitted to the needle bar 4. Hence, the needle bar 4 moves up and down. The hook 5 is linked with, via a gear mechanism 64, a lower shaft 64 that extends horizontally. When the hook 5 is attached horizontally, the gear mechanism 64 is, for example, a cylindrical worm gear that converts an axial angle to 90 degrees. The rotation of the lower shaft 63 is converted by 90 degrees by the gear mechanism 64 and is transmitted to the hook 5, and thus the hook 5 horizontally rotates.

The upper shaft 61 is provided with a pulley 65 that has a predetermined number of teeth. In addition, the lower shaft 63 is provided with a pulley 66 that has the same number of teeth as that of the pulley 65 of the upper shaft 61. Both pulleys 65, 66 are lined with each other by a toothed belt 67. When the upper shaft 61 rotates together with the rotation of the sewing-machine motor 6, the lower shaft 63 rotates via the pulleys 65, 66 and the toothed belt 67. Hence, the needle bar 4 and the hook 5 are actuated in synchronization with each other.

The presser foot 8 is attached to the leading end of a presser bar 81, and faces the needle plate 2 via the cloth 100 placed on the needle plate 2. The presser bar 81 is attached to a sewing-machine frame, extends vertically toward the needle plate 2, and is movable up and down along the direction of the axis of the needle bar 4. The presser bar 81 that moves up and down causes the presser foot 8 to move close to or move apart from the cloth 100.

(Detail of Presser Foot)

Figure 2:
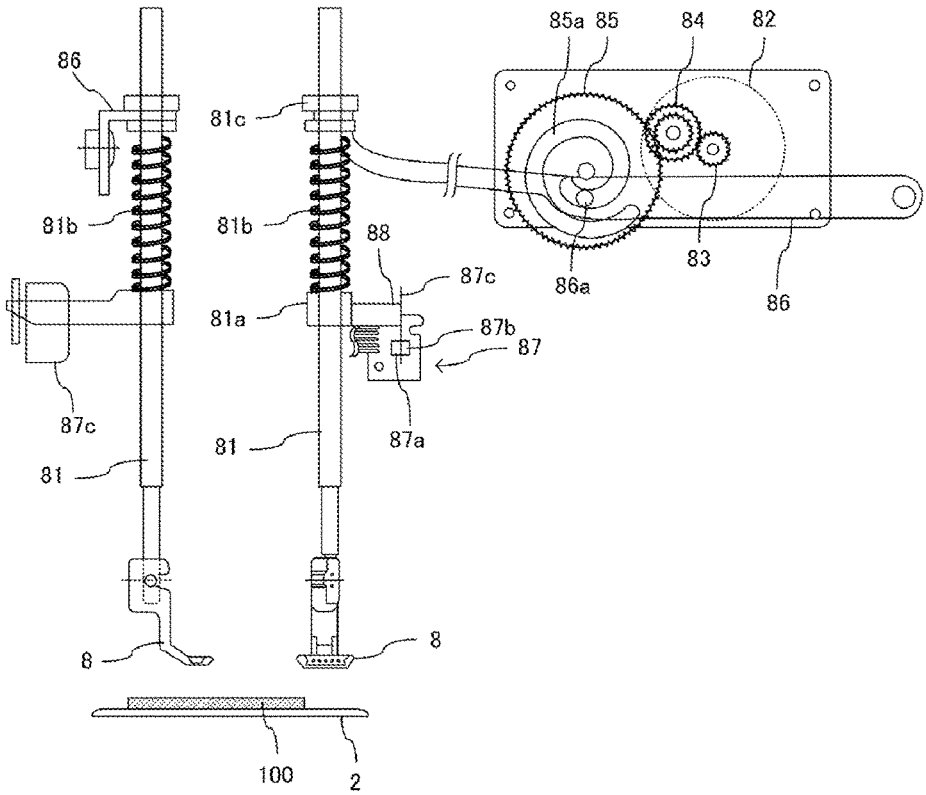
FIG. 2 is a diagram illustrating a detailed structure of a presser foot.

As illustrated in FIG. 2, the presser bar 81 utilizes, as an actuator, a stepping motor 82 built in the sewing machine 1. The stepping motor 82 includes a rotation shaft that has a drive gear 83. The drive gear 83 is meshed with a double-gear set 84. The double-gear set 84 includes a larger-diameter gear and a smaller-diameter gear integrated with each other on the same axis, and serves as an intermediate gear for deceleration. The larger-diameter gear is meshed with the drive gear 83.

The smaller-diameter gear is meshed with a cam disk 85 that has gear teeth arranged side by side along the outer circumference. The cam disk 85 has a parallel surface with the axis of the presser bar 81, and a spiral cam groove 85*a* that spreads out in a radial direction is formed in such a surface. The cam groove 85*a* has a spiral center that is the rotation center of the cam disk 85. The cam groove 85*a* is engaged with a follower protrusion 86*a*.

The follower protrusion 86*a* is provided on a presser-bar lifting lever 86 so as to protrude therefrom. The follower protrusion 86*a* is restricted so as to be slidable in parallel with the direction in which the presser bar 81 is slidable. The lever 86 has one end freely rotatably supported, and extends toward the presser bar 81 so as to be orthogonal to the presser bar 81 with a rotatably supported end being as a basal end. The lever 86 also has a leading end connected with the presser bar 81, and links to the presser foot 8 via the presser bar 81.

When the stepping motor 82 is actuated, the cam disk 85 rotates via the drive gear 83 and the double-gear set 84. In accordance with the rotation direction of the cam disk 85, the cam groove 85*a* traced by the follower protrusion 86*a* spreads out in the radial direction of the cam disk 85, or decreases in the radial direction of the cam disk 85. When the cam groove 85*a* spreads out in the radial direction, the follower protrusion 86*a* moves down toward the needle plate 2, and when the cam groove 85*a* traced by the follower protrusion 86*a* decreases in the radial direction, the follower protrusion 86*a* moves up so as to be apart from the needle plate 2.

When the follower protrusion 86*a* moves down, the lever 86 swings around the basal end, and pushes down the linked point with the presser bar 81, and thus the presser bar 81 is pushed down. When the follower protrusion 86*a* moves up, the lever 86 swings around the basal end, and pushes up the linked point with the presser bar 81, and thus the presser bar 81 moves up.

The presser bar 81 includes a flange 81*a* provided at a halfway location and spreading in the radial direction of the presser bar 81, and a compression spring 81*b* is fitted over the presser bar 81 with this flange 81*a* being as a spring seat. The leading end of the lever 86 is formed in a ring shape, and the presser bar 81 is fitted in this ring portion, and thus this ring portion depresses the compression spring 81*b*. The compression spring 81*b* has a spring constant that is set so as not to be compressed by the push-down force from the lever 86 when the presser foot 8 is in a floating condition. Hence, the presser bar 81 is pushed through the flange 81*a* via the compression spring 81*b*, and is moved down by the lever 86.

In addition, the presser bar 81 includes a flange 81*c* provided at the location right above the leading end of the lever 86, and spreading in the radial direction of the presser bar 81. When the lever 86 is swung up, such a leading end pushes up the flange 81*c*, and thus the presser bar 81 moves up.

The move-up or move-down amount of the presser bar 81 is detected by an encoder 87. The encoder 87 includes a photo interrupter, and an elongated linear scale 87*c*. The photo interrupter includes a light emitting diode 87*a*, and a photo transistor 87*b*. Those elements are fixed at respective stationary locations so as to face with each other. The elongated linear scale 87*c* includes slits which are arranged side by side in the lengthwise direction, and which are present between the light emitting diode 87*a* and the photo transistor 87*b*. The elongated linear scale 87*c* is fastened to a presser bar holder 88 that is fastened to the presser bar 81, and extends in parallel with the direction in which the presser bar 81 moves up and down.

When the presser bar 81 moves up or down, by the presser bar holder 88, the elongated linear scale 87*c* moves up or down in conjunction with the presser bar 81. The encoder 87 counts the number of slits of the elongated linear scale 87*c* which pass through between the light emitting diode 87*a* and the photo transistor 87*b*, and thus the move-up or move-down amount of the presser bar 81 is detected.

(Cloth-thickness Detection)

Figure 3:
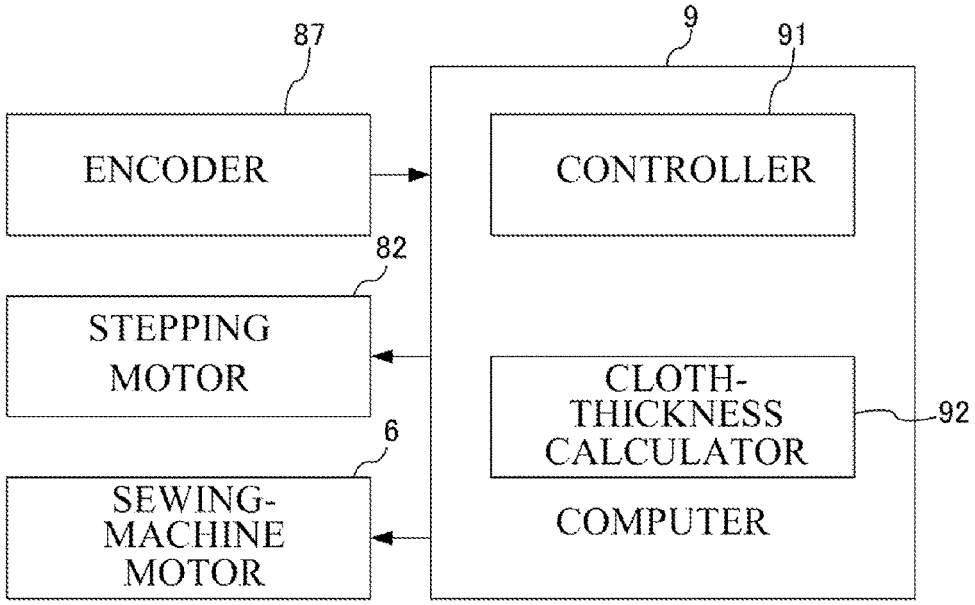
FIG. 3 is a block diagram illustrating a functional structure of a computer built in the sewing machine.

FIG. 3 is a block diagram illustrating a functional structure of a computer that controls each component of the sewing machine 1. A computer 9 is built in the sewing machine 1, and includes a CPU, memories, motor drivers for the stepping motor 82 that is a drive source for the presser-bar 81, and for a sewing-machine motor 6 that is a drive source for other components, and an interface that is connected with the encoder 87 of the presser foot 8. This computer 9 also includes a controller 91 and a cloth-thickness calculator 92.

The controller 91 outputs pulse signals to the sewing-machine motor 6 to drive each component of the sewing machine 1. In addition, the controller 91 outputs pulse signals with a constant pulse pith to the stepping motor 82 to swing up or swing down the lever 86 at a constant speed. Hence, the controller 91 moves up or moves down the presser foot 8 relative to the cloth 100.

Figure 4:
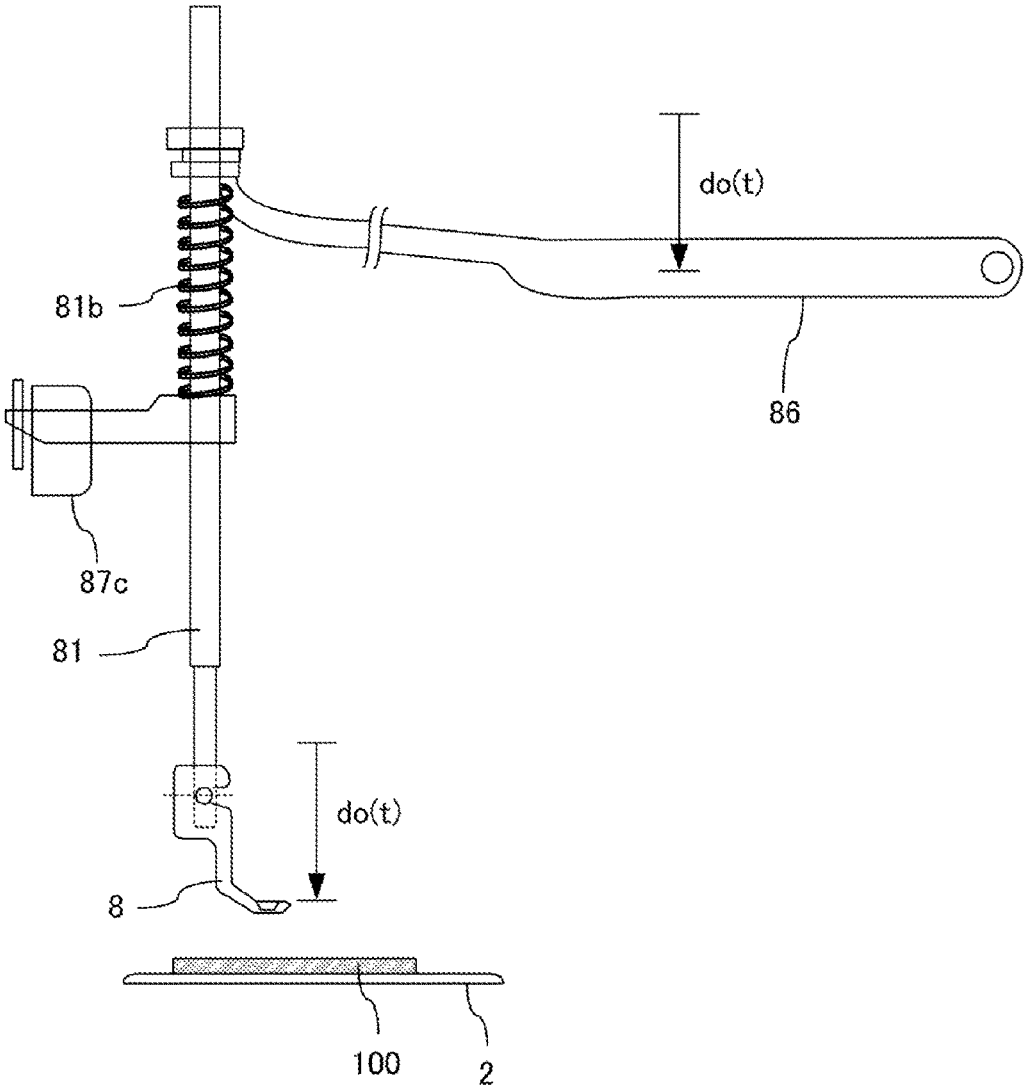
FIG. 4 is an exemplary diagram illustrating force applied to the presser foot before the presser foot contacts a cloth.
Figure 5:
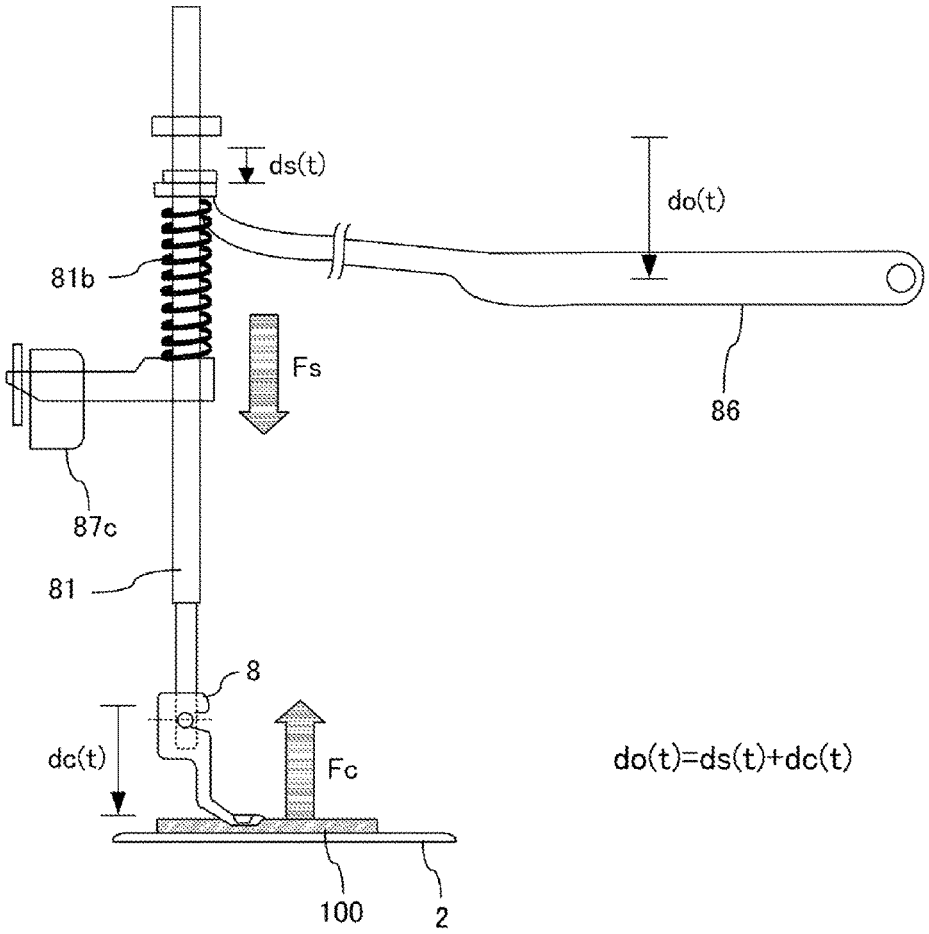
FIG. 5 is an exemplary diagram illustrating force applied to the presser foot while the presser foot is depressing the cloth.

The cloth-thickness calculator 92 utilizes the presser foot 8 as a cloth-thickness detection sensor, and calculates the thickness of the cloth 100 when no load is applied, and the stretch properties thereof. FIG. 4 is an exemplary diagram illustrating force applied to the presser foot 8 before the presser foot 8 contacts the cloth 100. FIG. 5 is an exemplary diagram illustrating force applied to the presser foot 8 when the cloth 100 is depressed by the presser foot 8.

As illustrated in FIG. 4, the controller 91 rotates the stepping motor 82 at a constant speed. The lever 86 is swung down by a swing-down amount do(t) that is equivalent to the rotation amount of the stepping motor 82. Before the presser foot 8 contacts the cloth 100, all of this swing-down amount do(t) is given to the presser foot 8, and thus the presser foot 8 is moved down at the move-down amount do(t) that is equivalent to the rotation amount of the stepping motor 82.

As illustrated in FIG. 5, when the presser foot 8 starts depressing the cloth 100, repulsive force Fc is applied from the cloth 100 to the presser foot 8. The compression spring 81*b* is compressed by the lever 86 until this repulsive force Fc is canceled by pushing force Fs. At this time, the lever 86 is swung down by a swing-down amount do(t) that is equivalent to the rotation amount of the stepping motor 82, and from this swing-down amount do(t), a compression amount ds(t) is separately given to the compression of the compression spring 81*b*, and thus the presser foot 8 is moved down by a move-down amount dc(t). The move-down amount dc(t) is detected as the number of slits by the encoder 87.

Figure 6:
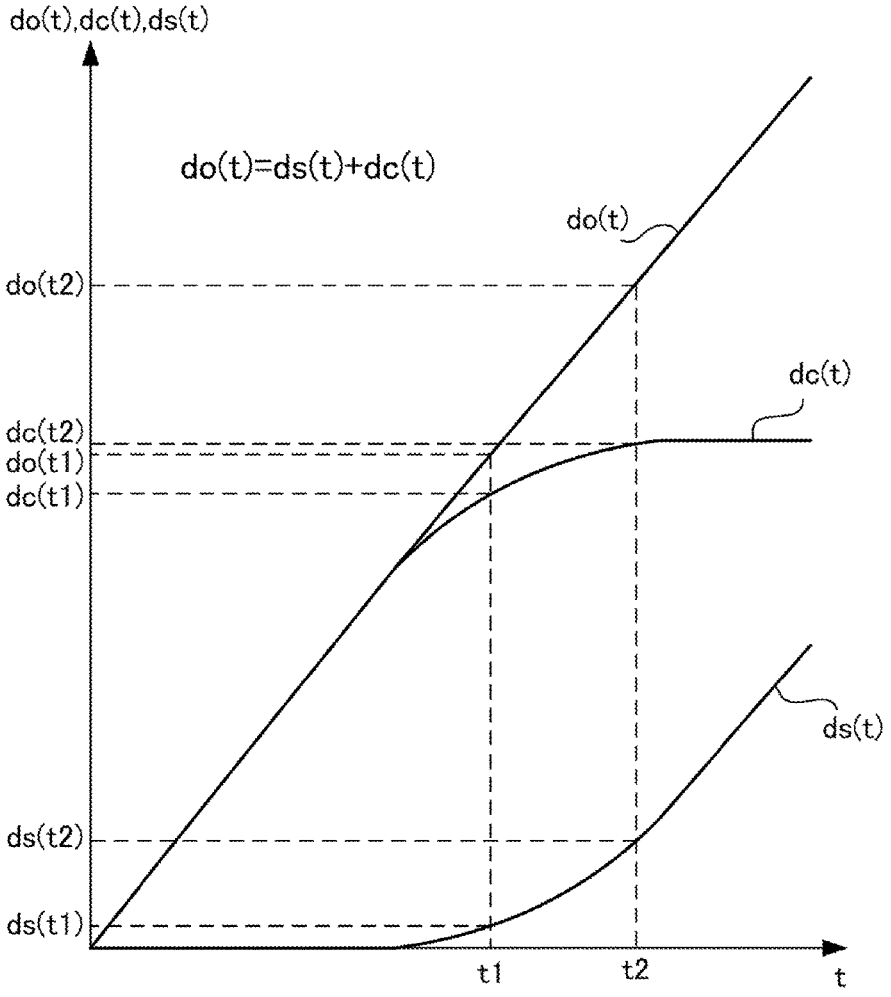
FIG. 6 is a time-series graph illustrating a move-down amount dc(t) of the presser foot and a compression amount ds(t) of a compression spring.

FIG. 6 is a time-series graph illustrating the move-down amount dc(t) of the presser foot 8 and the compression amount ds(t) of the compression spring 81*b*. As illustrated in FIG. 6, before the presser foot 8 contacts the cloth 100, the presser foot 8 moves down at the constant speed. When the presser foot 8 starts depressing the cloth 100, and further keeps moving down, the repulsive force Fc from the cloth 100 increases in response to the move-down operation of the presser foot 8. Hence, the compression spring 81*b* is compressed so as to cancel the repulsive force Fc, and gradually increases the compression amount ds(t). Conversely, the move-down amount dc(t) gradually decreases since some of this amount is divided to the compression amount ds (t), and eventually, the presser foot 8 stops. In each time point, a total of the move-down amount dc(t) and the compression amount ds(t) is equal to the swing-down amount do(t).

Figure 7:
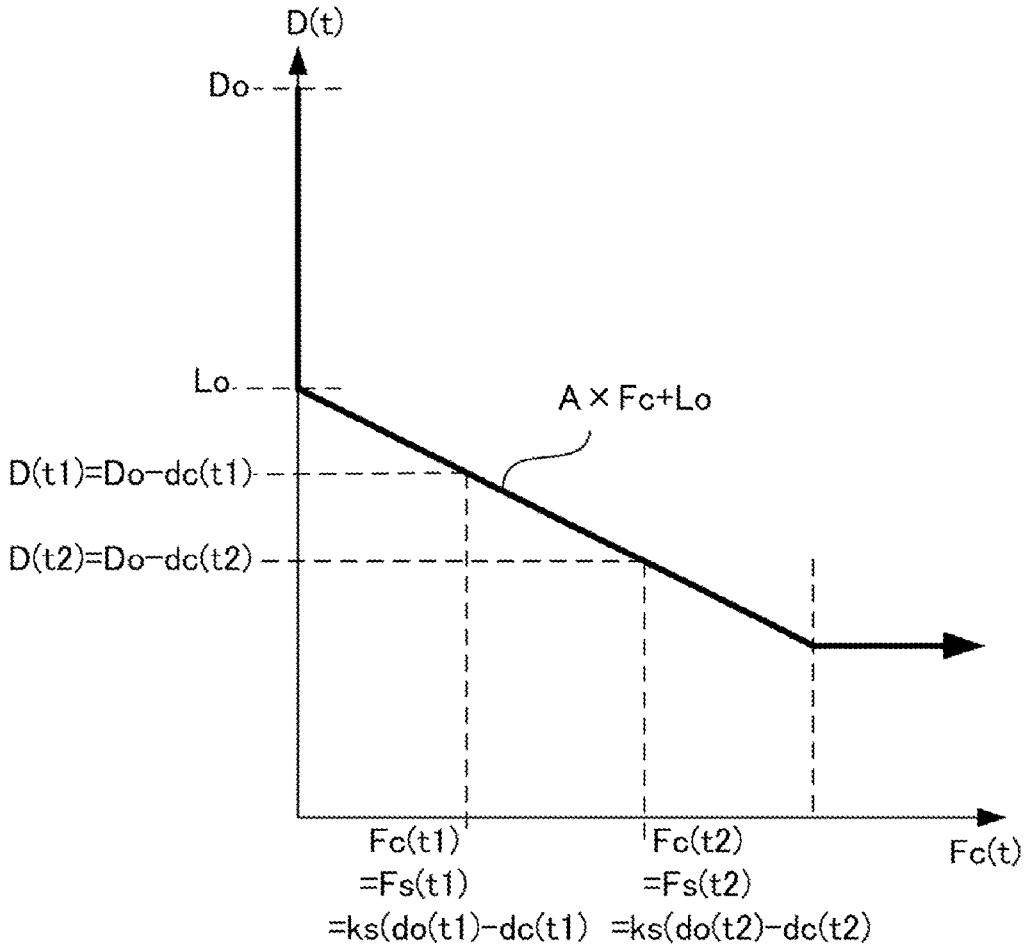
FIG. 7 is a graph illustrating a relationship between a height D(t) of the presser foot and repulsive force Fc.

FIG. 7 is a graph illustrating a relationship between a height D (t) of the presser foot 8 and a repulsive force Fc(t). As illustrated in FIG. 7, until the presser foot 8 contacts the cloth 100, the repulsive force Fc(t) is zero. After the presser foot 8 contacts the cloth 100, the lower the height D(t) of the presser foot 8 becomes, the more the repulsive force Fc(t) increases. When the cloth 100 is regarded as a spring, the repulsive force Fc(t) increases in proportional to the move-down amount of the presser foot 8.

In view of the foregoing, after the presser foot 8 is in contact with the cloth 100, a relationship between the height D(t) of the presser foot 8 and the repulsive force Fc(t) is expressed as the following formula (1). Note that the symbol A is a constant.

$$D(t)=A\times Fc(t)+Lo \quad (1)$$

In the above formula (1), Lo is the height of the presser foot 8 when the repulsive force Fc is zero, i.e., the thickness of the cloth 100 when no load is applied. Next, since the repulsive force Fc and the pushing force by the compression spring 81*b* is always balanced, when a spring constant of the compression spring 81*b* is ks, and a compression amount of the compression spring 81*b* at a given time t is ds(t), the above formula (1) can be converted into the following formula (2).

$$D(t)=A\times(ks\times ds(t))+Lo \quad (2)$$

In this case, the compression amount ds(t) is a result of subtracting the move-down amount dc(t) of the presser foot 8 from the swing-down amount do(t). In addition, the height D(t) of the presser foot 8 is a result of subtracting the move-down amount dc(t) of the presser foot 8 from the initial height Do before the presser foot 8 starts moving down. Hence, the above formula (2) can be converted into the following formula (3).

$$(Do-dc(t))=A\times[ks\times(do(t)-dc(t))]+Lo \quad (3)$$

The initial height Do and the swing-down amount do(t) are both known values, and the move-down amount dc(t) of the presser foot 8 is detectable by the encoder 87. Hence, when the spring constant ks of the compression spring 81*b* is measured beforehand, the unknown quantities are only two that are A and Lo. Hence, by measuring move-down amounts dc(t1) and dc(t2) of the presser foot 8 at different two timings t1, t2, the thickness Lo of the cloth 100 when no load is applied is drivable.

When a timing at which the presser foot 8 contacts the cloth 100 is defined as a timing tp, and a spring constant of the cloth 100 is defined as kc, since the pushing force Fs and the repulsive force Fc are always balanced while the presser foot 8 is moving down, and a compression amount ds(tp+t) is a difference between between a swing-down amount do(tp+t) and a move-down amount dc(tp+t), the following formula (4) is satisfied. In the following formula (4), since the unknown quantity is the spring constant kc only, when the spring constant kc is obtained, the stretch properties of the cloth 100 are obtainable.

$$ks\times(do(tp+t)-dc(tp+t))=kc\times(dc(tp+t)-dc(tp)) \quad (4)$$

The cloth-thickness calculator 92 receives information on the pulse signals from the controller 91 to the stepping motor 82, integrates a swing-down amount do(t) Δt per a unit time, and calculates a swing-down amount do(t1) at the timing t1 and a swing-down amount do(t2) at the timing t2.

In addition, the cloth-thickness calculator 92 receives an input of the number of slits from the encoder 87, integrates the number of slits, and calculates a move-down amount dc(t1) of the presser foot 8 at the timing t1 and a move-down amount dc(t2) of the presser foot 8 at the timing t2.

Next, the cloth-thickness calculator 92 creates simultaneous equations from the formula (3), and solves such simultaneous equations, thereby calculating a cloth thickness Lo of the cloth 100 when no load is applied. In addition, based on the number of slits when the presser foot 8 contacts the cloth 100 from a position corresponding to the cloth thickness Lo, a move-down amount dc(tp) of the presser foot 8 at the timing tp is calculated, thereby calculating stretch properties kc of the cloth 100 from the formula (4).

Before the presser foot 8 contacts the cloth 100, the number of slits per a unit time is constant, and the number of slits per a unit time beyond the stretch limit of the cloth 100 is zero. Hence, the cloth-thickness calculator 92 monitors the number of slits, sets the timing t1 after a timing at which the number of slits per a unit time changes, and sets the timing t2 before the number of slits per a unit time becomes zero. According to this setting, both the timing t1 and the timing t2 become sufficiently different timings from each other, and thus various parameters to solve the simultaneous equations are obtainable.

(Control Based on Cloth-Thickness Detection)

The controller 91 outputs pulse signals to the sewing-machine motor 6, and drives various components of the sewing machine 1. This controller 91 receives information on the thickness of the cloth 100 from the cloth-thickness calculator 92, and actuates the stepping motor 82 so as to cause the presser foot 8 to contact the surface of the cloth 100 with a thickness when no load is applied. Alternatively, the controller 91 receives information on the thickness of the cloth 100 and the stretch properties thereof from the cloth-thickness calculator 92, and actuates the stepping motor 82 so as to cause the presser foot 8 to depress the cloth 100 by predetermined pressure. Yet alternatively, the controller 91 receives information on the thickness of the cloth 100 from the cloth-thickness calculator 92, and actuates the stepping motor 82 so as to cause the presser foot 8 to be lifted up from the cloth 100 by a predetermined distance.

In addition, this controller 91 receives information on the stretch properties of the cloth 100 from the cloth-thickness calculator 92, adjusts the pull-up or tensioning of the needle thread 200, and the pull-up or tensioning of the bobbin thread 300, or adjusts the sewing speed, thereby forming a seam with a tightness that does not cause an improper sewing like a material puckering.

Still further, this controller 91 receives information on the stretch properties of the cloth 100 and the thickness thereof, and determines the cloth type of the cloth 100. Next, the controller 91 changes, inconsideration of the cloth type, the sewing condition that includes the depress pressure by the presser foot 8, the pull-up of the needle thread 200, the tensioning of the needle thread 200, the pull-down of the bobbin thread 300, the tensioning of the bobbin thread 300, and the sewing speed. At this time, for example, the sewing machine 1 may include a CCD camera that recognizes the cloth type based on images, and the controller 91 may also perform a cloth-type determination on the cloth 100 through the image processing in this case.

(Operation)

Figure 8:
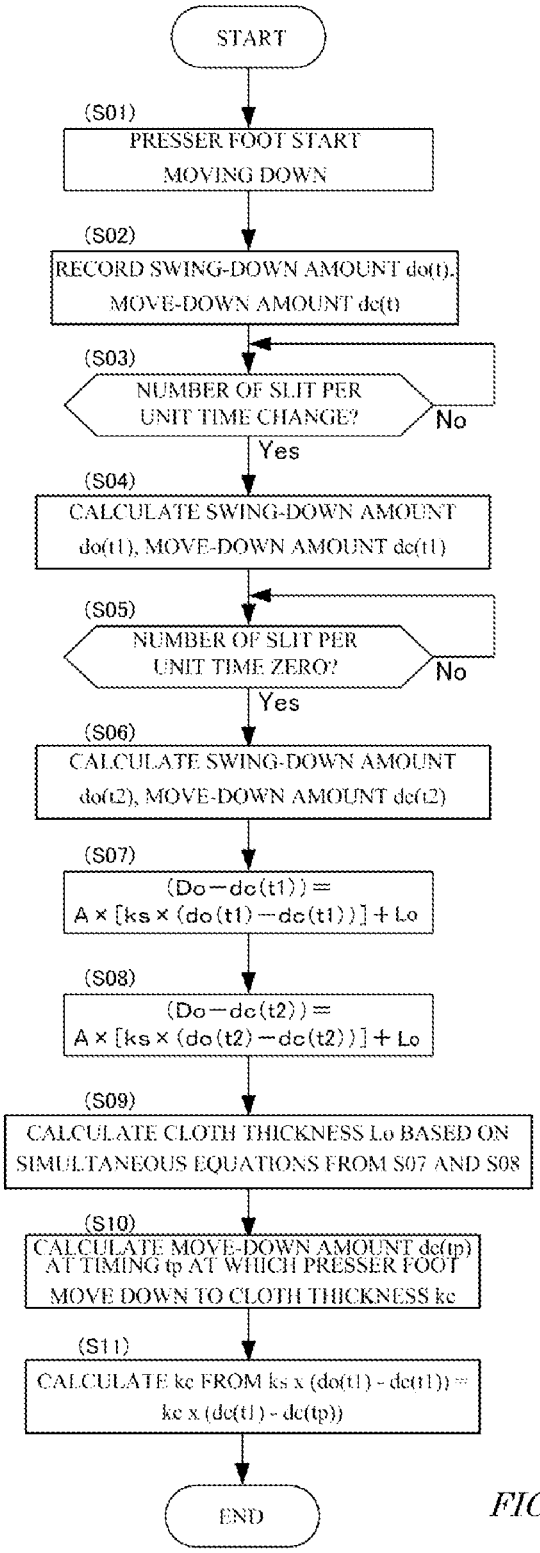
FIG. 8 is a flowchart illustrating an operation of a controller and that of a cloth-thickness calculator.

FIG. 8 is a flowchart illustrating an operation of the controller 91 and that of the cloth-thickness calculator 92 explained above. The controller 91 moves down (step S01) the presser foot 8. When the move-down operation of the presser foot 8 starts, the cloth-thickness calculator 92 records (step S02) the swing-down amount do(t) of the lever 86 in a chronological order based on the integral value of the number of pulses in the pulse signal. In addition, when the move-down operation of the presser foot 8 starts, the cloth-thickness calculator 92 also records (step S02) the move-down amount dc(t) of the presser foot 8 in a chronological order based on the integral value of the number of slits.

The cloth-thickness calculator 92 monitors the number of slits per a unit time Δt, and when the number of slits per a unit time Δt changes (step S03: YES), calculates (step S04) a move-down amount dc(t1) of the presser foot 8 and a swing-down amount do(t1) of the lever 86 both at the timing t1 after the unit time Δt from the timing at which such a change has occurred.

In addition, when the number of slits per a unit time Δt becomes zero (step S05: YES), the cloth-thickness calculator 92 calculates (step S06) a move-down amount dc(t2) of the presser foot 8 and a swing-down amount do(t2) of the lever 86 both at the timing t2 after the unit time Δt from the timing at which such a change has occurred.

Next, the cloth-thickness calculator 92 substitutes (step S07) the move-down amount dc(t1) and the swing-down amount do (t1) in the above formula (3) to create an equation, and also substitutes (step S08) the move-down amount dc(t2) and the swing-down amount do(t2) in the above formula (3) to create another equation. Subsequently, the cloth-thickness calculator 92 solves (step S09) the simultaneous equation to calculate a cloth thickness Lo of the cloth 100 when no load is applied.

In addition, the cloth-thickness calculator 92 calculates (step S10) the move-down amount dc(tp) of the presser foot 8 at a timing tp at which the presser foot 8 has been moved down to a cloth thickness kc. Next, the cloth-thickness calculator 92 substitutes the move-down amount dc(tp), the swing-down amount dc(t1), and the move-down amount dc(t1) in the above formula (4), and solves the equation to obtain (step S11) a stretch properties kc of the cloth 100.

(Action and Effect)

As explained above, this sewing machine 1 moves, relative to the cloth 100, up and down the presser foot 8 that depresses the cloth 100 by the lever 86, thereby depressing the cloth 100. The lever 86 is moved down by a constant amount by the actuator like the stepping motor 82. An elastic body like the compression spring 81*b* is present between the actuator and the presser foot 8. The elastic body is compressed by some of the constant move-down amount of the lever 86, and applies, to the presser foot 8, the pushing force Fs that cancels the repulsive force Fc from the cloth 100.

Next, the move-down amount of the presser foot 8 is detected by the encoder 87, and the cloth-thickness calculator 92 calculates the thickness of the cloth 100. The cloth-thickness calculator 92 performs such a calculation based on the number of instruction pulses to the stepping motor 82 and the detection value of the encoder 87 at the two timings while the presser foot 8 is depressing the cloth 100 and further attempts to move down.

Hence, the thickness of the cloth 100 when no load is applied is precisely detectable. This enables the sewing machine 1 to set a suitable sewing condition, thereby improving the sewing quality and the stitchwork quality. In order to allow the compression spring 81*b* to precisely respond to the repulsive force Fc, for example, the presser bar 81 may be hung by an extension spring, and the spring constant of this extension spring may be set so as to be slightly smaller than the spring constant ks of the compression spring 81*b*. The actuator is not limited to the stepping motor 82, and any of conventionally well-known technologies capable of moving the presser bar 81 up and down is also applicable. For example, a linear motor that directly moves the presser bar 81 up and down is applicable.

In the above embodiment, the cloth-thickness calculator 92 calculates the pushing force Fs equivalent to the repulsive force Fc based on the compression amount of the spring on the basis of the constant move-down amount of the lever 86, the move-down amount of the presser foot 8, and calculates the height of the presser foot 8 at a timing at which the calculated pushing force Fs becomes zero. The calculated height of the presser foot 8 is taken as the thickness of the cloth 100.

Detection of the thickness of the cloth 100 when no load is applied is theoretically possible by checking a timing at which the move-down amount of the presser foot 8 per a unit time changes, but since the repulsive force Fc from the cloth 100 is too small, it is quite difficult to detect a clear change point. According to this sewing machine 1, however, the thickness of the cloth 100 is calculated based on the pushing force Fs of the spring which is known beforehand instead of the repulsive force Fc from the cloth 100. Hence, the calculation of the thickness of the cloth 100 is simple and highly precise.

In addition, the cloth-thickness calculator 92 calculates the compression amount of the cloth 100 at a predetermined timing based on the thickness of the cloth 100 and the height of the presser foot 8, and calculates the stretch properties kc of the cloth 100 based on the pushing force Fs by the spring and the repulsive force Fc from the cloth 100. Hence, the thickness of the cloth 100 and the stretch properties when no load is applied are highly precisely detectable. This enables the sewing machine 1 to set a suitable sewing condition, thereby improving the sewing quality and the stitchwork quality.

(Other Embodiments)

The embodiment of the present invention was explained above, but various omissions, replacements, and modifications can be made without departing from the scope of the present invention. Such embodiments and modifications thereof are within the scope of the present invention, and are also within the scope of the invention as recited in appended claims and the equivalent range thereto.

For example, in order to detect the thickness of the cloth 100 and the stretch properties, a laser measurement process, an image determination process may be also applied. In this case, the presser foot 8 is provided with a laser measurement instrument, and the distance toward the cloth 100 from the presser foot 8 is measured to detect the contact of the presser foot 8 with the cloth 100, thereby determining the thickness of the cloth 100 based on the height of the presser foot 8. In addition, a CCD camera that captures a positional relationship between the presser foot 8 and the cloth 100 is attached to the sewing machine 1, and the contact of the presser foot 8 with the cloth 100 is detected through image processing, thereby determining the thickness of the cloth 100 based on the height of the presser foot 8.

What is claimed is:

1. A sewing machine comprising:

a presser foot attached to a lower end of a presser bar supported by a sewing machine frame so as to be movable up and down, the presser foot depressing a cloth to be sewn;

a lever linking to the presser foot moves up and down relative to the cloth;

an actuator moving down the lever at a predefined amount to depress the cloth with the presser foot;

an elastic body present between the actuator and the presser foot, the elastic body being compressed by the move-down operation of the lever at the predefined amount, and applying, to the presser foot, pushing force that cancels repulsive force from the depressed cloth;

an encoder detecting an amount the presser foot moves down; and a calculator setting two timings by monitoring the number of slits per a unit time counted by the encoder, the calculator calculating a thickness of the cloth when no load is applied based on the amount the presser foot moves down detected by the encoder at the two timings during a time period at which the presser foot depresses the cloth and attempts to further move down, wherein the two timings are a first timing set after the number of slits per a unit time changes and a second timing set before the number of slits per a unit time becomes zero.

2. The sewing machine according to claim 1, wherein the calculator:

calculates the pushing force that is equal to the repulsive force based on a compression amount of the elastic body on a basis of the predefined amount of the lever and the amount the presser foot moves down;

calculates a height of the presser foot at a timing at which the calculated pushing force becomes zero; and determines the calculated height of the presser foot as the thickness of the cloth.

3. The sewing machine according to claim 2, wherein the calculator creates, based on an initial height Do of the presser foot, a spring constant ks of the elastic body, move-down amounts dc(t1), dc(t2) at two timings t1, t2, and swing-down amounts do(t1), do(t2) of the lever at the two timings t1, t2, simultaneous equations including two equations from a following formula, solves the simultaneous equations, and obtains a thickness Lo;

$$(Do-dc(t))=A\times[ks\times(do(t)-dc(t))]+Lo,$$

where A and Lo are unknown quantities.

4. The sewing machine according to claim 1, wherein the calculator:

calculates a compression amount of the cloth at a predetermined timing based on the thickness of the cloth and a height of the presser foot; and calculates stretch properties of the cloth based on the pushing force by the elastic body and the compression amount of the cloth.

5. The sewing machine according to claim 4, further comprising a controller changing a sewing condition based on at least either the thickness of the cloth or the stretch properties.

* * * * *